US009620848B2

(12) United States Patent
Lee

(10) Patent No.: US 9,620,848 B2
(45) Date of Patent: Apr. 11, 2017

(54) DUAL BAND ANTENNA

(75) Inventor: Sunggyoo Lee, Machida (JP)

(73) Assignee: Lenovo (Singapore) Pte. Ltd., Singapore (SG)

( * ) Notice: Subject to any disclaimer, the term of this patent is extended or adjusted under 35 U.S.C. 154(b) by 7 days.

(21) Appl. No.: 13/367,625

(22) Filed: Feb. 7, 2012

(65) Prior Publication Data

US 2012/0200461 A1 Aug. 9, 2012

(30) Foreign Application Priority Data

Feb. 8, 2011 (JP) ..... 2011-024597

(51) Int. Cl.
*H01Q 1/24* (2006.01)
*H01Q 9/42* (2006.01)
*H01Q 5/371* (2015.01)

(52) U.S. Cl.
CPC ..... *H01Q 1/243* (2013.01); *H01Q 5/371* (2015.01); *H01Q 9/42* (2013.01)

(58) Field of Classification Search
CPC ..... H01Q 9/42; H01Q 5/371; H01Q 1/243
USPC ..... 343/702
See application file for complete search history.

(56) References Cited

U.S. PATENT DOCUMENTS 7,256,743 B2 * 8/2007 Korva ..... H01Q 1/244 343/702
7,616,158 B2 * 11/2009 Mak et al. ..... 343/700 MS
7,764,236 B2 * 7/2010 Hill et al. ..... 343/702
7,782,261 B2 * 8/2010 An et al. ..... 343/702
7,932,861 B2 * 4/2011 Hung et al. ..... 343/700 MS
8,072,389 B2 * 12/2011 Chang et al. ..... 343/846
8,305,284 B2 * 11/2012 Tai et al. ..... 343/846
2002/0135525 A1 * 9/2002 Ikegaya et al. ..... 343/767
2004/0233111 A1 * 11/2004 Desclos ..... H01Q 1/38 343/700 MS
2005/0195124 A1 * 9/2005 Puente et al. ..... 343/893
2007/0285321 A1 * 12/2007 Chung ..... H01Q 1/38 343/702

FOREIGN PATENT DOCUMENTS

JP 2004064282 2/2004
JP 2007-28255 A1 2/2007
(Continued)

*Primary Examiner* — Dameon E Levi
*Assistant Examiner* — Hasan Islam
(74) *Attorney, Agent, or Firm* — Ference & Associates LLC

(57) ABSTRACT

There is provided an apparatus comprising: a first radiation element having a horizontal pattern extending in parallel with a ground element and having a first open end; a second radiation element having a horizontal pattern extending in parallel with the ground element and having a second open end; wherein each of said first radiation element and second radiation element connects to the ground element; wherein said second open end of the second radiation element occupies an area surrounded by a horizontal pattern of the first radiation element and the ground element; and a driven element including a first excitation pattern extending along the horizontal pattern of the first radiation element and a second excitation pattern extending along the horizontal pattern of the second radiation element. Other embodiments are disclosed.

16 Claims, 4 Drawing Sheets

(56) References Cited

FOREIGN PATENT DOCUMENTS

| | | | |
|---|---|---|---|
| JP | 2007214961 | | 8/2007 |
| JP | 2008-278219 | A1 | 11/2008 |
| JP | 2009135633 | | 6/2009 |
| JP | 2010-232820 | A1 | 10/2010 |
| JP | 2010288175 | | 12/2010 |

* cited by examiner

DUAL BAND ANTENNA

CLAIM FOR PRIORITY

This application claims priority from Japanese Application No. 2011-024597, filed on Feb. 8, 2011, and which is fully incorporated by reference as if fully set forth herein.

FIELD OF THE INVENTION

The subject matter described herein relates to a dual band antenna mountable in a wireless terminal.

BACKGROUND

There are frequencies for cellular phones in North America, namely the PCS (Personal Communications Service) band and the cellular band. In the PCS band, a frequency band from 1700 MHz to 2200 MHz is used as the 2 GHz band. In the cellular band, a frequency band from 820 MHz to 960 MHz has been previously used as the 800 MHz band, and recently, a mobile telecommunications service based on a communication standard called LTE (Long Term Evolution) has started as the 700 MHz band in the cellular band.

In the United States, Verizon Wireless Inc. and AT&T Inc. offer wireless data communication services using LTE. Verizon Wireless Inc. uses a frequency band from 747 MHz to 787 MHz, and AT&T Inc. uses a frequency band from 704 MHz to 746 MHz. Cellular phones or smart phones have only to be equipped with an antenna adapted to a frequency band of either of the companies, whereas it is desired that notebook computers (hereinafter called laptop PCs) and other types of mobile computing devices, including tablets, netbooks, and ultra laptops be equipped with an antenna adapted to a range of frequencies from 704 MHz to 787 MHz to cover the frequency bands of both companies in order to use the frequency band for cellular phones in the United States.

Japanese Patent No. 4121799 discloses a dual band antenna composed of an exciter and two quarter-wavelength antennas. The exciter is composed of a dipole antenna resonating with a fundamental frequency and a harmonic resonance frequency. One quarter-wavelength antenna is an inverted-L dipole antenna resonating with the fundamental frequency and the other quarter-wavelength antenna is an inverted-L dipole antenna resonating with an n-order harmonic resonance frequency. The open end of the one quarter-wavelength antenna is electrostatically coupled to the exciter in a position in which the current distribution of the fundamental frequency is minimized, and the open end of the other quarter-wavelength antenna is electrostatically coupled to the exciter in a position in which the current distribution of the n-order harmonic resonance frequency is minimized.

Japanese Patent Application Publication No. 2010-288175 discloses a multiband antenna of a T monopole structure composed of a common conductor and two horizontal conductors different in length. This antenna has the common conductor and the respective horizontal conductors form a quarter-wavelength radiation conductor to resonate with two frequencies and operate in a serial resonance mode. With this antenna, it is described that the low frequencies adapt to the 800 MHz band.

Japanese Patent Application Publication No. 2007-214961 discloses a multiband antenna apparatus capable of reducing electrostatic coupling among multiple antennas. A support base member includes a flat face portion and peripheral end faces orthogonal to the flat face portion. A first antenna element and a second antenna element are branched from the same power feed point. The first antenna element is laid out along the peripheral end faces and the second antenna element is provided along the peripheral end face of the flat face portion. The distal ends of the antenna elements are arranged orthogonal to each other at positions where the distal ends do not face each other. With this antenna, it is described that the low frequencies adapt to the 800 MHz band.

Japanese Patent Application Publication No. 2009-135633 discloses an antenna in common use with multiple frequencies for mobile terminals, composed of an inverted-L driven element, a first radiation conductor, and a second radiation conductor. The first radiation conductor having one folded portion and the second radiation conductor having two folded portions are branched in opposite directions from a common conductor connected to the ground. The first radiation conductor is arranged partially in parallel with a horizontal portion of the driven element and capacitively coupled. The second radiation conductor is arranged partially in parallel with the first radiation conductor and capacitively coupled. With this antenna, it is described that low frequencies adapt to the 900 MHz band.

"A Study of Broadband Monopole Antenna with Parasitic Elements," Sugimoto, et. al., 2008 IEICE Tokyo Branch Student Research Conf. discloses an asymmetric monopole antenna having a size incorporable in a mobile terminal as shown in FIG. 6A and ultrawideband characteristics. This antenna is composed of a T-shaped feed element and inverted-L parasitic elements respectively having branch conductors parallel to each other on both sides of a common portion of the feed element. Use of the parasitic elements results in exciting two new resonances in a high frequency range, achieving a wider bandwidth from 1.9 GHz to 5 GHz.

Since the antenna increases in length as the resonance frequency decreases, a large space is required to accommodate low frequencies. An inverted-F dual-band antenna as shown in FIG. 6B has been mounted in traditional laptop PCs. The laptop PCs are required to incorporate multiple antennas in a display case for wireless communication, such as WLAN and WiMAX, in addition to cellular phone lines. However, when the antenna structure of FIG. 6B is adopted for a new antenna to adapt the low-frequency side to the 700 MHz band, the length of each element increases, causing a problem that it cannot be accommodated in the limited space.

Further, in order to incorporate a new antenna in a laptop PC, it is necessary to achieve a wide bandwidth capable of covering the frequency bands of both companies in the United States within the limits of space given to traditional antennas. It is also necessary to mount multiple antennas in a small space in a laptop PC, and this may not be able to secure enough distance therebetween depending on the mounting condition. Therefore, there is a need for the new antenna to have a structure that is not likely to cause radio wave interference with other antennas.

The dual band antenna described in Japanese Patent No. 4121799 requires a space equal to or larger than the sum of the lengths of the horizontal portions of the two quarter-wavelength antennas in the longitudinal direction of the antenna pattern. In the T-shaped asymmetric monopole antenna described in "A Study of Broadband Monopole Antenna with Parasitic Elements," Sugimoto, et. al., 2008 IEICE Tokyo Branch Student Research Conf., since the open ends of the two inverted-L parasitic elements extend out in opposite directions, a large space is also required in the longitudinal direction of the antenna pattern. Further, since none of the antennas described in the above-mentioned related art documents conforms to the 700 MHz band, there is a need to develop an antenna having a new structure capable of being accommodated in a small space provided in a laptop PC.

BRIEF SUMMARY

An apparatus comprising: a first radiation element having a horizontal pattern extending in parallel with a ground element and having a first open end; a second radiation element having a horizontal pattern extending in parallel with the ground element and having a second open end; wherein each of said first radiation element and second radiation element connects to the ground element; wherein said second open end of the second radiation element occupies an area surrounded by a horizontal pattern of the first radiation element and the ground element; and a driven element including a first excitation pattern extending along the horizontal pattern of the first radiation element and a second excitation pattern extending along the horizontal pattern of the second radiation element.

An apparatus comprising: an antenna pattern formed on a dielectric substrate, said antenna pattern further comprising: a horizontally extending pattern of a first radiation element; a horizontally extending pattern of a second radiation element; and a ground element; wherein both horizontally extending patterns and the ground element are attached to the dielectric substrate; and wherein the horizontally extending patterns are arranged at approximately 90 degrees from one another.

Furthermore, another aspect provides an apparatus comprising: an antenna; wherein elements of said antenna comprise: a first radiation element; and a second radiation element; said first radiation element and said second radiation element being formed into a first horizontal pattern and a second horizontal pattern; wherein each of said first horizontal pattern and said second horizontal pattern has an open end and an portion extending in parallel with a ground element; wherein each of said first horizontal pattern and said second horizontal pattern is connected at the ground element such that the open end of the second radiation element enters an area surrounded by the first horizontal pattern of the first radiation element and the ground element; and a driven element comprising a first excitation element and a second excitation element, each of the first excitation element and the second excitation element having a common power source and extending along horizontal elements of the first radiation element and second radiation element.

The foregoing is a summary and thus may contain simplifications, generalizations, and omissions of detail; consequently, those skilled in the art will appreciate that the summary is illustrative only and is not intended to be in any way limiting For a better understanding of the embodiments, together with other and further features and advantages thereof, reference is made to the following description, taken in conjunction with the accompanying drawings. The scope of the invention will be pointed out in the appended claims.

DETAILED DESCRIPTION

Figure 1:
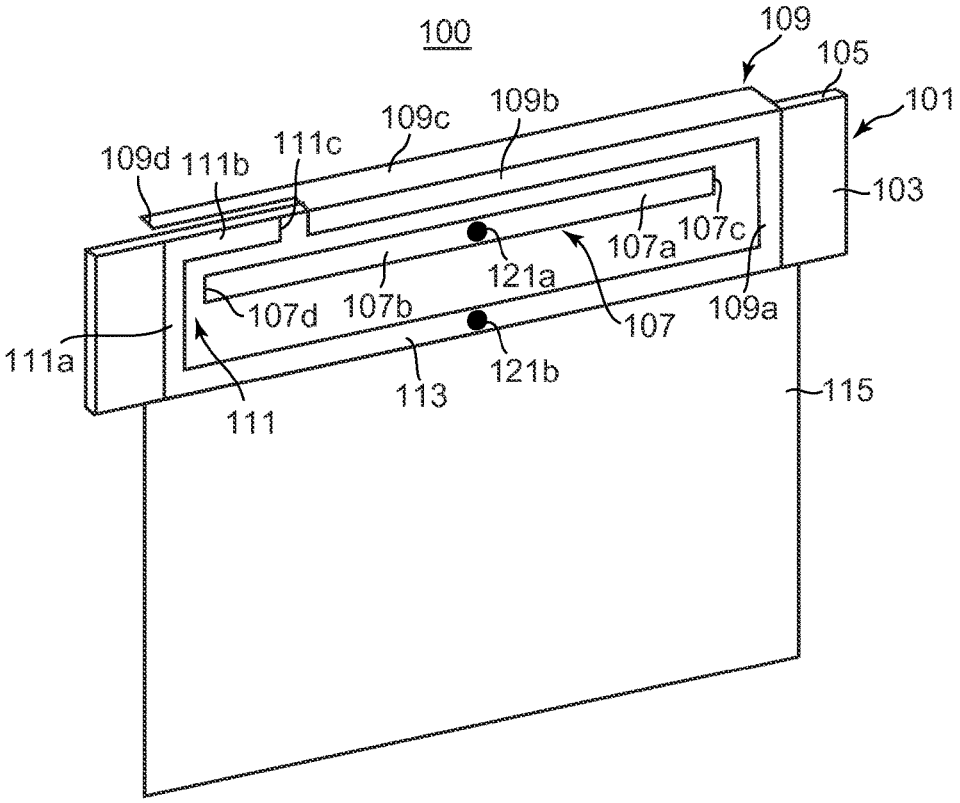
FIG. 1 is perspective view showing the basic structure of a dual band antenna according to an embodiment.

It will be readily understood that the components of the embodiments, as generally described and illustrated in the figures herein, may be arranged and designed in a wide variety of different configurations in addition to the described example embodiments. Thus, the following more detailed description of the example embodiments, as represented in the figures, is not intended to limit the scope of the embodiments, as claimed, but is merely representative of example embodiments.

Reference throughout this specification to "one embodiment" or "an embodiment" (or the like) means that a particular feature, structure, or characteristic described in connection with the embodiment is included in at least one embodiment. Thus, appearances of the phrases "in one embodiment" or "in an embodiment" or the like in various places throughout this specification are not necessarily all referring to the same embodiment.

Furthermore, the described features, structures, or characteristics may be combined in any suitable manner in one or more embodiments. In the following description, numerous specific details are provided to give a thorough understanding of embodiments. One skilled in the relevant art will recognize, however, that the various embodiments can be practiced without one or more of the specific details, or with other methods, components, materials, etc. In other instances, well-known structures, materials, or operations are not shown or described in detail to avoid obfuscation. The following description is intended only by way of example, and simply illustrates certain example embodiments.

The remainder of the disclosure begins with a general overview and proceeds to give a more detailed description of example embodiments with reference to the accompanying figures.

In view of the above described conventional arrangements, an embodiment provides a compact dual band antenna capable of being incorporated in a wireless terminal Further another embodiment provides a dual band antenna having a wide frequency bandwidth in the 700 MHz band. Further another embodiment provides a dual band antenna capable of reducing radio wave interference with adjacent antennas. Further another embodiment provides a wireless terminal with such a dual band antenna incorporated therein.

Embodiments provide a dual band antenna including antenna elements formed into patterns on a dielectric substrate and used with a first fundamental frequency and a second fundamental frequency. A first radiation element makes a junction with one end of a ground edge, including a horizontal pattern having an open end and extending in parallel with the ground edge. A second radiation element makes a junction with the other end of the ground edge, including a horizontal pattern having an open end and extending in parallel with the ground edge so that the open end will enter an area surrounded by the horizontal pattern of the first radiation element and the ground edge.

A driven element includes a first excitation pattern extending along the horizontal pattern of the first radiation element and a second excitation pattern extending along the horizontal pattern of the second radiation element, and having a common power supply. At least part of the horizontal pattern of the second radiation element on the open end side is arranged in an area formed between the first radiation element and the ground edge. Further, the first radiation element and the second radiation element are supplied with power indirectly from the driven element. Therefore, the antenna according to the subject matter described herein can form antennas adapted to two fundamental frequencies in a small space.

The horizontal pattern of the first radiation element can also include a horizontally extending pattern having an open end and arranged on a flat surface intersecting at right angles with a flat surface on which the driven element is formed. In such a structure, the open end of the horizontally extending pattern can reduce electromagnetic wave interference that may occur with the second radiation element and adjacent other antennas. Further, the length of the shorter side of the antenna pattern can be reduced. The first radiation element and the first excitation pattern can be composed of quarter-wavelength monopole antennas, respectively.

The first excitation pattern resonates at a quarter wavelength with an m-order harmonic frequency relative to the first fundamental frequency, and the first radiation element resonates with the m-order harmonic frequency at a predetermined wavelength by means of an electromagnetic wave induced from the first excitation pattern and further resonates with the first fundamental frequency at the quarter wavelength. The first radiation element can establish electrostatic coupling and electromagnetic coupling with the driven element subjected to harmonic resonance to resonate with a harmonic, and further resonates with the first fundamental frequency, achieving a wide frequency bandwidth. At this time, if m is set to 3 or 5, excellent characteristics can be obtained while enabling downsizing. The frequency band of the first fundamental frequency can be set in a range from 704 MHz to 787 MHz. The horizontal pattern of the first radiation element can include an impedance adjustment portion expanded into a trapezoidal shape toward the ground edge.

The second radiation element and the second excitation pattern can be composed of quarter-wavelength monopole antennas, respectively. The structure can also be such that the second excitation pattern resonates with an n-order harmonic frequency relative to the second fundamental frequency, and the second radiation element resonates with the n-order harmonic frequency at a predetermined wavelength by means of an electromagnetic wave induced from the second excitation pattern and further resonates with the second fundamental frequency at the quarter wavelength. Since the size of the antenna is roughly determined by the size of the first radiation element, if the antenna is accommodated in the size, the second radiation element may resonate at a quarter wavelength of the second fundamental frequency. The frequency band of the second fundamental frequency can be set in a range from 1700 MHz to 2200 MHz. The first radiation element and the second radiation element can be inverted-L monopole antennas. The driven element can be a linear antenna or a T monopole antenna having a power supply at the center.

Embodiments also provide a compact dual band antenna mountable in a wireless terminal Embodiments also provide a dual band antenna with a wide range of frequencies in the 700 MHz band. Still other embodiments provide a dual band antenna capable of reducing radio wave interference with adjacent antennas. Other embodiments provide a wireless terminal with such a dual band antenna mounted therein.

Antenna Structure

Figure 2:
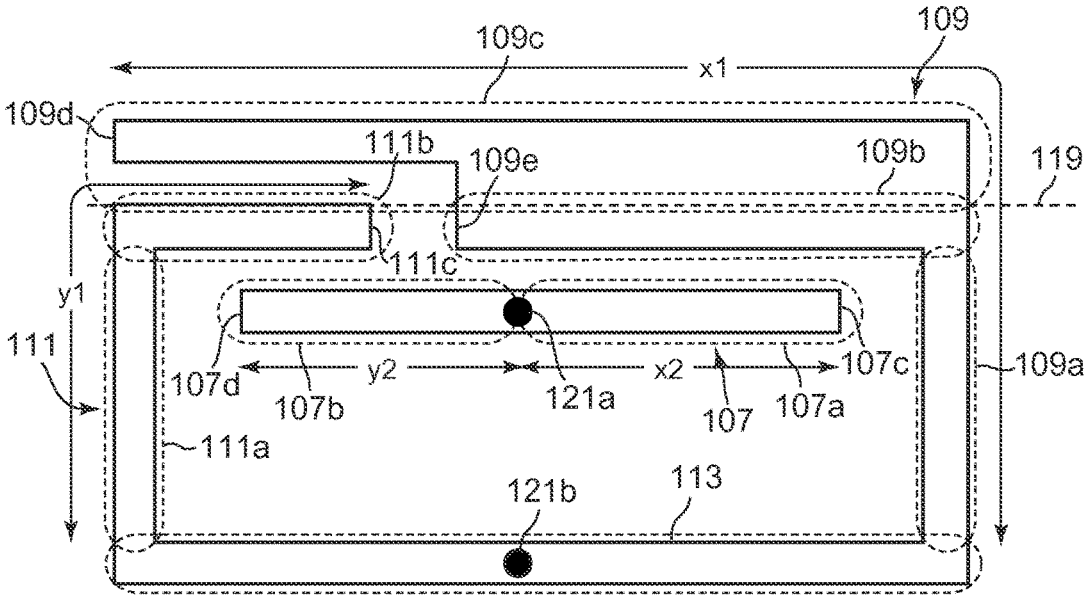
FIG. 2 is a plan view of an antenna pattern excluding a ground plane and a dielectric substrate from the antenna in FIG. 1

Referring now to the figures, FIG. 1 is a perspective view showing the basic structure of a dual band antenna 100 (hereinafter, simply called "antenna") according to an example embodiment. FIG. 2 is a plan view of an antenna pattern excluding a ground plane 115 and a dielectric substrate 101 from the antenna 100. As shown in FIG. 1, a flat surface on which a horizontally extending pattern 109*c* of the antenna pattern exists intersects at 90 degrees with a flat surface on which horizontal pattern 109*b* exists, but both of the patterns are illustrated in FIG. 2 as if they exist on the same flat surface for the sake of illustration. Note that the subject matter described herein includes the case where the horizontally extending pattern 109*c* is arranged on the same flat surface as the horizontal pattern 109*b*.

The antenna 100 adapts to a frequency band on the low-frequency side used in a range of frequencies from 704 MHz to 787 MHz and a frequency band on the high-frequency side used in a range of frequencies from 1700 MHz to 2200 MHz. Suppose that 746 MHz (approximately the center of the frequency band on the low-frequency side) is set as fundamental frequency $f_H$ on the low-frequency side and its wavelength is denoted as $\lambda_H$. Suppose also that 1950 MHz (approximately the center of the frequency band on the high-frequency side) is set as fundamental frequency $f_L$ of the high-frequency side and its wavelength is denoted as $\lambda_L$. The antenna 100 is composed of three members, i.e., an antenna pattern formed on a principal plane 103 of the dielectric substrate 101 by performing photolithography and etching processes on a printed circuit board, the horizontally extending pattern 109*c* and the ground plane 115, both of which are soldered to the antenna pattern of the principal plane 103, respectively.

The shape of the dielectric substrate 101 is a thin plate-like rectangular parallelepiped having the principal plane 103 for providing an area, in which the antenna pattern is formed, and four side faces 105. On the principal plane 103, patterns of a driven element 107, a low-frequency radiation element 109, a high-frequency radiation element 111, and a ground element 113 are formed. Note that the low-frequency radiation element 109 includes the horizontally extending pattern 109*c* that is not formed on the dielectric substrate 101. The ground element 113 provides an area in which the ground plane 115 is connected with a linear pattern extending in parallel with one linear edge of the ground plane 115. In the ground element 113, a power supply 121*b* on the ground side is defined almost at the center in the longitudinal direction.

The driven element 107 is a linearly-formed, grounded-type quarter-wavelength monopole antenna, which is disposed in parallel with the ground element 113 with a power supply 121*a* on the voltage side defined almost at the center. In the driven element 107, the power supply 121*a* acts as a border between a low-frequency excitation pattern 107*a* having a length of X2 up to one open end 107*c* and a high-frequency excitation pattern 107*b* having a length of y2 up to the other open end 107*d*.

The excitation patterns 107*a* and 107*b* extend in parallel with the ground element 113 with the open ends 107*c* and 107*d* facing in the opposite directions to form linear antennas, respectively. A coaxial cable connected to a wireless module including a high-frequency oscillator is connected to the power supply 121*a*, 121*b* to supply high-frequency power. The excitation patterns 107*a* and 107*b* resonate with odd-order harmonics, such as three times or five times of the fundamental frequencies $f_L$, and $f_H$, respectively, at predetermined wavelengths. The driven element 107 can be composed of a quarter wavelength T-shaped monopole antenna.

A vertical pattern 109*a* of the radiation element 109 makes a junction with one end of the ground element 113. The vertical pattern 109*a* extends perpendicular to the ground element 113 on the principal plane 103. The horizontal pattern 109*b* makes a junction with the vertical pattern 109*a*. The horizontal pattern 109*b* extends up to an end 109*e* in parallel with the ground element 113. The horizontal pattern 109*b* includes the horizontally extending pattern 109*c* arranged on a flat surface intersecting at 90 degrees with the principal plane 103 on the border indicated by dashed line 119. Note that 90 degrees is an example of an intersection angle when being housed in a laptop PC, but other cases where the horizontally extending pattern 109*c* intersects with the horizontal pattern 109*b* at other angles are also included in the scope of the subject matter described herein.

The horizontally extending pattern 109*c* is formed of a flat, thin plate-like conductor, and disposed along a side face 105. The horizontally extending pattern 109*c* is soldered to the horizontal pattern 109*b*. The horizontally extending pattern 109*c* extends in parallel with the ground element 113 up to an open end 109*d* located further ahead of the end 109*e* of the horizontal pattern 109*b*. In the embodiment, the horizontally extending pattern 109*c* is fabricated as a separate member from the horizontal pattern 109*b* and both are soldered together, but they may be formed as an integrated pattern and folded along the dashed line 119. The low-frequency radiation element 109 resonates with a predetermined frequency as an inverted-L quarter-wavelength monopole antenna to radiate an electromagnetic wave.

The length, x1, of the radiation element 109 from the ground element 113 to the open end 109*d* is so adjusted that the radiation element 109 will resonate at a quarter wavelength of the wavelength $\lambda_L$. The radiation element 109 having the length of x1 also resonates with a harmonic relative to the fundamental frequency $f_L$. The horizontal pattern 109*b* is arranged to be parallel to at least part of the excitation pattern 107*a* on the principal plane 103 to receive electromagnetic wave energy from the excitation pattern 107*a* by means of electrostatic coupling and electromagnetic coupling. A state in which the horizontal pattern 109*b* and the excitation pattern 107*a* are electrically coupled and arranged in parallel with each other on the same flat surface so that electromagnetic wave energy can be sent and received is referred to as overlapping.

A vertical pattern 111*a* of the radiation element 111 makes a junction with the other end of the ground element 113. The vertical pattern 111*a* extends perpendicular to the ground element 113 on the principal plane 103. A horizontal pattern 111*b* makes a junction with the vertical pattern 111*a*. The horizontal pattern 111*b* extends in parallel with the ground element 113 in a direction in which an open end 111*c* faces the end 109*e*. A predetermined clearance is provided between the end 109*e* and the open end 111*c* to reduce electromagnetic wave interference therebetween.

The horizontal pattern 111*b* may be so formed that the open end 111*c* will extend toward the vertical pattern 109*a* in parallel with the excitation pattern 107*b*. The horizontal pattern 111*b* is so arranged that the open end 111*c* will exist in an area surrounded by a vertical line drawn from the open end 109*d* to the ground element 113, the ground element 113, and the radiation element 109. The radiation element 111 resonates with a predetermined frequency as an inverted-L quarter wavelength dipole antenna to radiate an electromagnetic wave.

The length, y1, of the radiation element 111 from the ground element 113 to the open end 111*c* is so adjusted that the radiation element 111 will resonate at a quarter wavelength of the wavelength $\lambda_H$. The radiation element 111 having the length of y1 also resonates with a harmonic relative to the fundamental frequency $f_H$. The horizontal pattern 111*b* overlaps at least part of the excitation pattern 107*b* to establish electrostatic coupling and electromagnetic coupling. The meaning of overlapping is as described above.

In FIG. 2, it appears that the high-frequency horizontal pattern 111*b* goes inside the low-frequency horizontally extending pattern 109*c* on the same flat surface. However, since they actually exist on a flat surface on which both intersect at 90 degrees as shown in FIG. 1, radio wave interference therebetween does not occur. Further, since at least part of the horizontal pattern 111*b* is arranged to enter a space between the horizontally extending pattern 109*c* and the excitation pattern 107*b*, the length of the longitudinal direction of the antenna pattern parallel to the ground element 113 can be shortened. In addition, since a structure in which the horizontally extending pattern 109*c* is arranged on the flat surface on which it intersects with the principal plane 103 at 90 degrees is adopted, the length of the shorter side of the antenna pattern perpendicular to the ground element 113 can also be shortened.

Method of Determining Antenna Pattern

When a predetermined installation space is given inside a laptop PC, the pattern of the antenna 100 can be determined according to the following procedure: At first, the length, x1, of the radiation element 109 resonating with the quarter wavelength of the low-frequency fundamental frequency $f_L$ is determined to be $\lambda_L/4$. The length and shape of the radiation element 109 roughly determines the size of the antenna 100. Since the physical length of the radiation element 109 to resonate is shorter than $\lambda_L/4$ due to the influence of ambient permittivity and the speed of an electromagnetic wave propagating through the inside of the conductor, the optimum length for resonance at the quarter wavelength can be determined from experiment.

Next, a ratio of length between the vertical pattern 109*a* and the horizontally extending pattern 109*c* is determined. The ratio is determined so that not only the antenna 100 can be fitted into the given space, but also the driven element 107 can be formed in a space inside the radiation element 109 and surrounded by the radiation element 109 and the ground element 113. When resonating at the quarter wavelength of the wavelength $\lambda_L$ of the fundamental frequency, the radiation element 109 resonates with a harmonic at a wavelength of $m\lambda_m/4$, where m is an odd number and $\lambda_m$ is the m-th harmonic wavelength.

The phenomenon of resonating a harmonic relative to the fundamental frequency is called higher harmonic resonance, and the frequency at the time is called a harmonic resonance frequency $f_m$. If the excitation pattern 107*a* is resonated at a quarter wavelength of wavelength $\lambda_m$ of the harmonic resonance frequency $f_m$, m=×1/×2 is obtained in theory. At this time, the physical length of the excitation pattern 107*a* to resonate is shorter than $\lambda_m/4$ for the same reason as the radiation element 109. Therefore, m calculated from actual lengths x1 and x2 may not be an integer. Then, the harmonic resonance frequency $f_m$ used to receive electromagnetic wave energy from the excitation pattern 107*a* is determined from among standing waves of multiple harmonic resonance frequencies $f_m$ with which the radiation element 109 resonates.

It is preferred that the order m of the harmonic resonance frequency $f_m$ should be small to increase the transmission efficiency of electromagnetic wave energy. However, the smaller the order m, the longer the length of x2 relative to the predetermined length of x1. Therefore, consideration is required to determine whether the excitation pattern 107*a* can be accommodated in an area surrounded by the radiation element 109 and the radiation element 111. Then, a value as small as possible within a range allowed for the space given to the driven element 107 is selected as the order m.

Next, the pattern of the radiation element 111 and the length of the excitation pattern 107*b* are determined for the high-frequency fundamental frequency $f_H$ in the same procedure. It is apparent from FIG. 2 that, since the radiation element 111 is arranged mostly in a space determined by the radiation element 109 and the ground element 113, the lengths of the radiation element 111 and the excitation pattern 107*b* hardly affect the overall size as long as the structure as shown in FIG. 2 is adopted. In one embodiment, it is desired to set the order m on the low-frequency side to 3 or 5. As for the high-frequency side, if the length of the excitation pattern 107*b* can be put in a predetermined space, it can resonate the fundamental frequency $f_H$ at the wavelength of $\lambda_H/4$ without higher harmonic resonance.

Description of Operation

Figure 3:
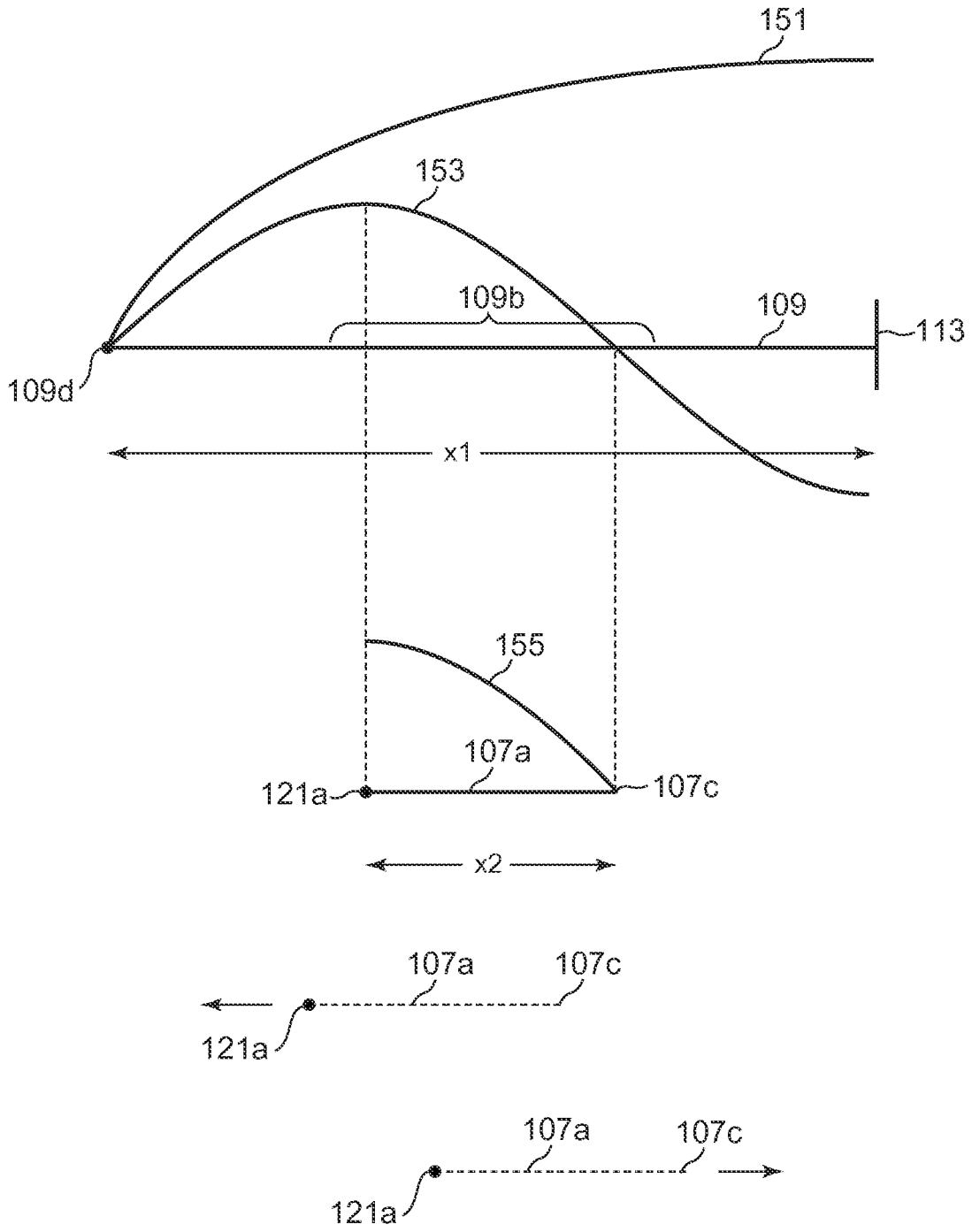
FIG. 3 is a graph showing a current distribution of standing waves generated in a low-frequency radiation element and an excitation pattern FIGS. 4(A-B) depicts fabricated antenna patterns according to embodiments.

Next, the operation of the antenna 100 will be described. FIG. 3 is a graph showing a current distribution of standing waves generated in the radiation element 109 and the excitation pattern 107*a*. In FIG. 3, the radiation element 109 is illustrated as a linear antenna for the purpose of describing standing waves. A high-frequency voltage with fundamental frequency $f_L$ is supplied from the coaxial cable to the power supply 121*a*, 121*b*. The excitation pattern 107*a* having the length of x2 resonates at a quarter wavelength with a third-order harmonic resonance frequency of a wavelength of $\lambda_L/3$ to generate a standing wave 155. Since the excitation pattern 107*a* resonates with the fundamental frequency of the third-order harmonic, a high-frequency voltage with a frequency three times the fundamental frequency $f_L$ may be supplied from the coaxial cable.

In the excitation pattern 107*a*, the standing wave 155 reaches the maximum current and the minimum voltage at the position of the power supply 121*a*. Further, the standing wave 155 reaches the minimum current and the maximum voltage at the open end 107*c*. Since the high-frequency excitation pattern 107*b* does not resonate with higher harmonics of the fundamental frequency $f_L$, the excitation pattern 107*b* does not resonate with the fundamental frequency $f_L$. The standing wave 155 generated in the excitation pattern 107*a* establishes electromagnetic coupling and electrostatic coupling with part of the horizontal pattern 109*b* of the radiation element 109 to induce an electromagnetic wave in the radiation element 109 with the same frequency. The length, x1, of the radiation element 109 and the relative position of the excitation pattern 107*a* in the longitudinal direction of the horizontal pattern 109*b* are so determined that the radiation element 109 will resonate with the third-order harmonic frequency.

For example, as indicated by the dashed lines in FIG. 3, if the relative position of the excitation pattern 107*a* moves along the horizontal pattern 109*b* on the side of the open end 109*d* or the opposite side, no standing wave of the third-order harmonic frequency will not be generated in the radiation element 109. The current and voltage induced by the radiation element 109 are distributed as a standing wave 153 of the third-order harmonic frequency. The standing wave 153 reaches the minimum current and the maximum voltage at the open end 109*d*. Further, the current distribution and the voltage distribution at each position of the horizontal pattern 109*b* facing the excitation pattern 107*a* match those of the standing wave 155 on the excitation pattern 107*a*.

Since the radiation element 109 resonates with the fundamental frequency $f_L$, at the quarter wavelength, the standing wave 153 further generates a standing wave 151 at the wavelength $\lambda_L$. The standing wave 151 reaches the minimum current and the maximum voltage at the open end 109*d*. Further, the standing wave 151 reaches the maximum current and the minimum voltage at the junction with the ground. Thus, an electromagnetic wave with the fundamental frequency $f_L$ is radiated from the radiation element 109.

Likewise, on the high-frequency side, when a high-frequency voltage with the fundamental frequency $f_H$ is supplied to the power supply 121*a*, 121*b*, the excitation pattern 107*b* resonates with a harmonic to establish electrostatic coupling and electromagnetic coupling between the excitation pattern 107*b* and the horizontal pattern 111*b* of the radiation element 111. The radiation element 111 that received electromagnetic wave energy from the excitation pattern 107*b* radiates an electromagnetic wave with the fundamental frequency $f_H$ on the same principle as the low-frequency side. When the excitation pattern 107*b* does not resonate with any harmonic, both the excitation pattern 107*b* and the radiation element 111 resonate the fundamental frequency $f_H$ at the quarter wavelength.

Actual Conductor Pattern

Figure 4A:
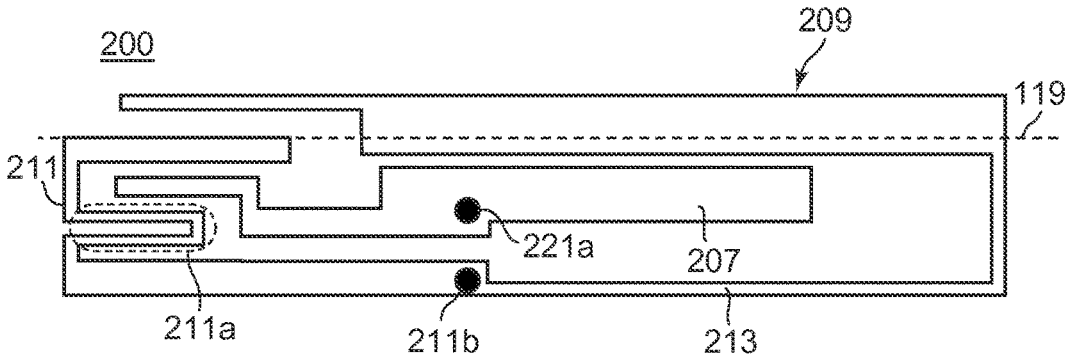

FIG. 4 contains diagrams showing conductor patterns of antennas actually fabricated and the availability of which was confirmed in a low-frequency band from 704 MHz to 787 MHz and a high-frequency band from 1700 MHz to 2200 MHz. The antenna patterns shown in FIG. 4 correspond to the antenna pattern in FIG. 2. An antenna 200 shown in FIG. 4A includes a driven element 207, a low-frequency radiation element 209, a high-frequency radiation element 211, and a ground element 213 to radiate electromagnetic waves by being supplied with power from power supply 221*a*, 221*b*. The radiation element 211 is modified from the inverted-L basic structure to provide a length adjusting pattern 211*a* for adjusting the length to resonate with the quarter wavelength of the fundamental frequency $f_H$. The length adjusting pattern 211*a* is formed in a space between the driven element 207 and the ground element 213 so that the overall size of the antenna pattern will not be increased.

The antenna 200 can realize a wider frequency bandwidth particularly for the fundamental frequency $f_L$, on the low-frequency side. The following reason is considered: The radiation element 209 is a parasitic element indirectly supplied with power by electrostatic coupling and electromagnetic coupling with the driven element without being directly supplied with voltage at the fundamental frequency $f_L$. Then, the driven element 207 as a feed element resonates with a harmonic frequency relative to the fundamental frequency $f_L$, so that the radiation element 209 resonates with the fundamental frequency by means of an electromagnetic wave induced in the radiation element 209 by an electromagnetic wave resulting from higher harmonic resonance.

Figure 4B:
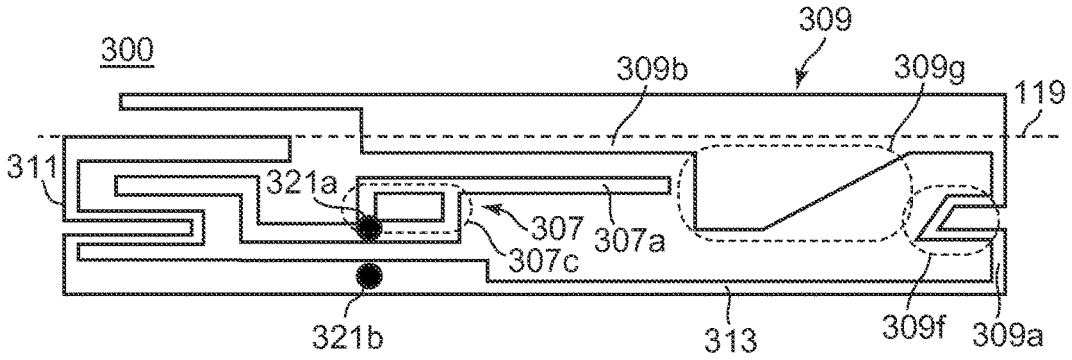

An antenna 300 shown in FIG. 4B includes a driven element 307, a low-frequency radiation element 309, a high-frequency radiation element 311, and a ground element 313 to radiate electromagnetic waves by being supplied with power from a power supply 321*a*, 321*b*. A bandwidth expanding pattern 307*c* is formed into an excitation pattern 307*a* of the driven element 307 to expand frequency bandwidths. The bandwidth expanding pattern 307*c* provides two passages for current flowing into the excitation pattern 307*a* to widen the frequency bandwidths for electromagnetic waves radiated from the driven element 307.

The antenna element 309 also includes a length adjusting pattern 309*f* and an impedance adjusting pattern 309*g*. Like the length adjusting pattern 211*a*, the length adjusting pattern 309*f* plays a role in adjusting the length so that the radiation element 309 will resonate at the quarter wavelength of the fundamental frequency $f_L$. The impedance adjusting pattern 309*g* is formed by enlarging a horizontal pattern 309*b* into a trapezoidal shape toward the ground element 313, playing a role in adjusting the impedance of the radiation element 309 to make impedance matching with the coaxial cable.

Method of Installing Antenna

Figure 5:
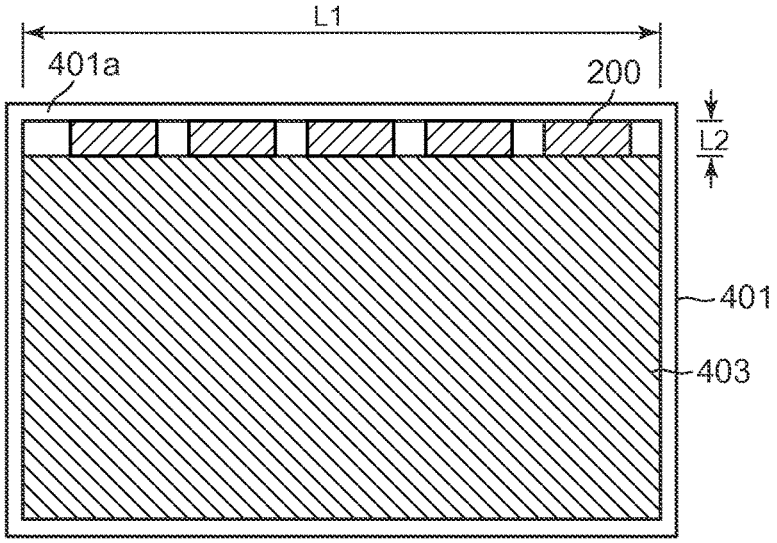
FIG. 5 is a plan view showing an antenna installed in a laptop PC.
Figure 6A:
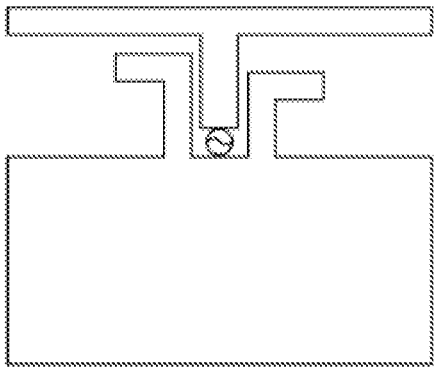
FIGS. 6(A-B) depicts diagrams of conventional antenna structures.
Figure 6B:
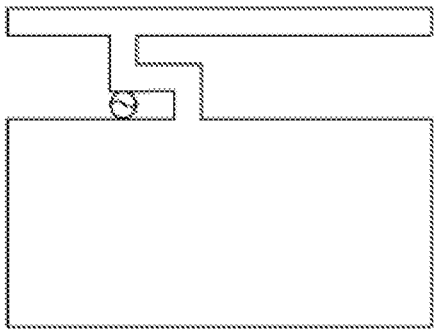
FIG. 6B (Prior Art)

FIG. 5 is a plan view showing a state in which the antenna 200 is installed in a laptop PC. A display case 401 internally houses a liquid crystal display (LCD) 403. A total of five antennas are provided in a space having a length of L1 on the longer side and a length of L2 on the shorter side between an upper edge 401*a* of the display case 401 and the LCD 403. The antennas are different in structure from one another, but at least one of them is the antenna 200. The antenna 200 is so arranged that an antenna pattern on the principal plane will become parallel to the bottom of the display case 401, and the ground plane is arranged between the LCD 403 and the bottom of the display case 401.

The antenna 200 is so formed that the length on the shorter side of the principal plane 103 falls within L2. When five antennas are arranged in the length of L1, enough distance cannot be kept between antennas. If a radiation element with the maximum field intensity and the open end of the driven element come close to adjacent antennas, radio wave interference may occur. However, since the open end of the low-frequency radiation element 209 is located on a flat surface on which it intersects at 90 degrees with an antenna pattern of any adjacent antenna on the principal plane, the radio wave interference can be reduced.

The open end of the high-frequency radiation element 211 faces inward, and this does not cause radio wave interference with adjacent antennas. Further, since both open ends of the driven element 207 are surrounded by the high-frequency radiation element 211 and the low-frequency radiation element 209, they do not cause radio wave interference with the adjacent antennas as well. Thus, the antenna 200 has a structure suitable for cases where multiple antennas are arranged in a limited space.

In the above explanation, embodiments are described with particular characteristics shown in drawings. However, the disclosure is not limited to these embodiments shown in the drawings, and as far as the advantageous effects described can be achieved, other embodiments can adopt any configuration that has been known until now. If not otherwise stated herein, it is to be assumed that all patents, patent applications, patent publications and other publications (including web-based publications) mentioned and cited herein are hereby fully incorporated by reference herein as if set forth in their entirety herein.

Embodiments have been described with reference to specific examples illustrated in the drawings. However, these are simply non-limiting examples, and of course, so long as the effects are obtained, any kind of well known configuration can be employed.

What is claimed is:

1. An apparatus comprising:

a dual band antenna including antenna elements formed into patterns on a dielectric substrate to adapt to a first fundamental frequency and a second fundamental frequency, the dual band antenna comprising:

a first radiation element conforming to the first fundamental frequency and making a junction with one end of a ground edge, including a horizontal pattern having an open end and extending in parallel with the ground edge;

a second radiation element conforming to the second fundamental frequency and making a junction with another end of the ground edge, including a horizontal pattern having an open end and extending in parallel with the ground edge so that the open end of the second radiation element will enter an area surrounded by the horizontal pattern of the first radiation element and the ground edge; and a driven element including a first excitation pattern extending along the horizontal pattern of the first radiation element and a second excitation pattern extending along the horizontal pattern of the second radiation element;

the dual band antenna having a common power supply;

wherein the horizontal pattern of the first radiation element includes a horizontally extending pattern having an open end and arranged on a flat surface intersecting at right angles with a flat surface on which the driven element is formed.

2. The apparatus of claim 1, wherein the first radiation element and a first excitation pattern are quarter-wavelength monopole antennas.

3. The apparatus of claim 2, wherein a first excitation pattern of the driven element resonates at a quarter wavelength with a harmonic frequency relative to a first fundamental frequency, and the first radiation element resonates with m-order harmonic frequency at a predetermined wavelength via an electromagnetic wave induced from the first excitation pattern and further resonates with the first fundamental frequency at the quarter wavelength;

wherein m is a number selected from the group consisting of 3 and 5.

4. The apparatus of claim 3, wherein a frequency band of the first fundamental frequency is in a range from 704 MHz to 787 MHz.

5. The apparatus of claim 1, wherein the first radiation element includes an impedance adjustment portion expanded into a trapezoidal shape toward the ground element.

6. The apparatus of claim 1, wherein the second radiation element forms a quarter-wavelength monopole antenna.

7. The apparatus of claim 1, wherein a frequency band of the second fundamental frequency is in a range from 1700 MHz to 2200 MHz.

8. The apparatus of claim 1, wherein the first radiation element and the second radiation element are inverted-L monopole antennas.

9. The apparatus of claim 1, wherein the driven element is a linear antenna having a power supply.

10. An apparatus comprising:

a multi-element antenna formed on a dielectric substrate, said antenna further comprising:

a first inverted-L radiation element conforming to a first fundamental frequency and making a junction with one end of a ground edge, including a horizontal pattern having an open end and extending in parallel with the ground edge;

a second inverted-L radiation element conforming to a second fundamental frequency and making a junction with another end of the ground edge, including a horizontal pattern having an open end and extending in parallel with the ground edge so that the open end of the second radiation element will enter an area surrounded by the horizontal pattern of the first radiation element and the ground edge; and a ground element to which the first inverted-L radiation element and the second inverted-L radiation element attach at opposites ends;

wherein the second inverted-L radiation element extends between the ground element and the first inverted-L radiation element;

wherein both of the first inverted-L radiation element and second inverted-L radiation element and the ground element and a linearly formed driven element are attached to the dielectric substrate; and wherein the first inverted-L radiation element includes elements disposed orthogonally from one another;

wherein the horizontal pattern of the first radiation element includes a horizontally extending pattern having an open end and arranged on a flat surface intersecting at right angles with a flat surface on which the driven element is formed.

11. The apparatus of claim 10, wherein:

the first inverted-L radiation element is a low frequency radiation element; and the second inverted-L radiation element is a high frequency radiation.

12. The apparatus of claim 11, wherein said low frequency radiation element includes a portion that is not disposed on the substrate.

13. The apparatus of claim 10, further comprising:

a linearly formed driven element has a first excitation pattern and a second excitation pattern.

14. The apparatus of claim 10, wherein said apparatus is a mobile computing device.

15. An apparatus comprising:

a display case;

a multi-element antenna disposed in the display case;

wherein elements of said antenna comprise:

a common ground element;

a first inverted-L radiation element conforming to a first fundamental frequency and making a junction with one end of a ground edge, including a horizontal pattern having an open end and extending in parallel with the ground edge; and a second inverted-L radiation element conforming to a second fundamental frequency and making a junction with another end of the ground edge, including a horizontal pattern having an open end and extending in parallel with the ground edge so that the open end of the second radiation element will enter an area surrounded by the horizontal pattern of the first radiation element and the ground edge;

wherein said first inverted-L radiation element and said second inverted-L radiation element are disposed orthogonally to each other and extend in opposite horizontal directions;

wherein said second inverted-L radiation element extends between the common ground element and said first inverted-L radiation element;

wherein an end of the second inverted-L radiation element extends into an area surrounded by part of the first inverted-L radiation element and the common ground element;

wherein the horizontal pattern of the first radiation element includes a horizontally extending pattern having an open end and arranged on a flat surface intersecting at right angles with a flat surface on which a linear driven element is formed; and said linear driven element comprising a first excitation element and a second excitation element, each of the first excitation element and the second excitation element having a common power source and extending along the first inverted-L radiation element and second inverted-L radiation element.

16. The apparatus according to claim 15, wherein:

the first inverted-L radiation element and the inverted-L second radiation element form a dual band antenna;

the first inverted-L radiation element is longer than the second inverted-L radiation element; and the first inverted-L radiation element communicates using a lower frequency than the second inverted-L radiation element.

* * * * *